US006032001A

United States Patent [19]

Miyawaki

[11] Patent Number: 6,032,001

[45] Date of Patent: Feb. 29, 2000

[54] REMOTE DIAGNOSIS SYSTEM AND METHOD FOR AN IMAGE FORMING APPARATUS

[75] Inventor: Shohzoh Miyawaki, Urawa, Japan

[73] Assignee: Ricoh Co., Ltd., Tokyo, Japan

[21] Appl. No.: 09/122,778

[22] Filed: Jul. 27, 1998

[30] Foreign Application Priority Data

Jul. 25, 1997 [JP] Japan ..... 9-199904

[51] Int. Cl.[7] ..... G03G 15/00

[52] U.S. Cl. ..... 399/8; 399/9; 399/18; 399/81

[58] Field of Search ..... 399/8, 9, 10, 18, 399/81; 364/138, 479.11, 479.14; 340/825.06, 825.16

[56] References Cited

U.S. PATENT DOCUMENTS 5,282,127 1/1994 Mii ..... 399/8 X
5,325,156 6/1994 Ulinski ..... 399/8
5,543,892 8/1996 Hirata et al. ..... 399/8
5,715,496 2/1998 Sawada et al. ..... 399/8

*Primary Examiner*—William Royer
*Assistant Examiner*—Hoan Tran
*Attorney, Agent, or Firm*—Oblon, Spivak, McClelland, Maier & Neustadt, P.C.

[57] ABSTRACT

A remote diagnosis system including a plurality of image forming apparatus each having a trouble informing device, and a central controller for receiving data including a trouble indicator indicative of a problem which may or has occurred in each of the image forming apparatus and for responding to this data. Also included is a data communication apparatus, connected to each of the plurality of image forming apparatus and the central controller, for receiving the data including the trouble indicator from each of the plurality of image forming apparatus, and for transmitting this data to the central controller. The remote diagnosis system further includes a trouble classifying device for classifying causes of trouble which may occur in each of the image forming apparatus. In addition, the data communication apparatus collects data classified by the classifying device.

14 Claims, 17 Drawing Sheets

Fig.12

| CODE | PROCESS NAME | CONTENT |
|---|---|---|
| 30 | SC Call | Auto Call When a SC problem Occures |
| 31 | Manual Call | Auto Call When a Manual Switch is Depressed |
| 32 | Alarm Sending | Auto Alarm Call |
| 33 | Supply Request Call | Auto Call When a Supply Request SW is Depressed |
| 22 | Block Billing | Auto Call When Block Billing is Counteded up |
| 02 | Data Reading | Reading Data stored inside of a PPC |
| 04 | Data Writing | Writing Data stored inside of a PPC |
| 03 | Execution | Test by a Remote Control Manner |
| 08 | Device Code Check | Check Communication Function |

Fig.13

| Code | Data Length | Content |
|---|---|---|
| Information Code | 11 | representing a kind of specific information |
| Figure of Data Part | 2 | representing data length of a following data part by an ASCII code(00, no data part) |
| Data Part | changeable | Data corresponds to each information codes (no data in a field,if the fugure of data part is 00) |

REMOTE DIAGNOSIS SYSTEM AND METHOD FOR AN IMAGE FORMING APPARATUS

BACKGROUND OF THE INVENTION

1. Field of the Invention

The present invention relates to a network communication technology, and in particular, to a remote diagnosis system including a plurality of image forming apparatus connected to a central control apparatus which is capable of providing to the central control apparatus predetermined trouble indicators indicating a problem which have or may occur in each of the plurality of image forming apparatuses.

2. Discussion of the Background

In recent years, a variety of remote diagnosis systems have been proposed. Such conventional systems generally include at least a plurality of image forming apparatus respectively disposed at a plurality of user stations and a central control apparatus connected to each of the image forming apparatuses. The central control apparatus may be disposed at a sales dealer or a service center, thus forming a network with the plurality of image forming apparatus. The conventional central control apparatus generally receives a plurality of trouble indicators which indicate the image forming apparatus requires repair, for example. In the remote diagnosis system, if the plurality of trouble indicators are simultaneously received by the central control apparatus, the central control apparatus tends to overwork in trying to respond to the trouble indicators. To solve such a problem, a remote diagnosis system, as described in the Japanese Laid Open Patent Application No. 6-20512, transmits to the central controller a trouble indicator only if the discovered problem is assigned a higher value than a problem which has previously occurred. This process is executed in order to avoid overworking the central control apparatus.

However, in such a technology, if a part is broken and a new one is required in the image forming apparatus, the problem indicator is not transmitted to the central control apparatus unless it has a value higher than a problem which previously occurred. Thus, it is possible the problem may prevent a user from using the apparatus in a case when a trouble indicator is not a higher value than that which has previously occurred.

SUMMARY OF THE INVENTION

The present invention resolves the above-described problem and relates to a remote diagnosis system which includes a plurality of image forming apparatus which each have a trouble informing device. Also included is a central controller for receiving, from each of the image forming apparatus, data indicative of the trouble. The central controller also responds to this trouble. In addition, the remote diagnosis system includes a data communication apparatus, connected to each of the plurality of image forming apparatus and to the central controller, for receiving data indicative of a problem which may have occurred in a respective image forming apparatus. The data communication apparatus then transmits this data to the central controller. In addition, each of the trouble informing devices includes a trouble classifying device which classifies reasons or causes why the trouble has occurred in a particular image forming apparatus. Further, the data communications apparatus collects the data classified by the classifying device.

Further, the remote diagnosis system includes a plurality of displays respectively disposed in each of the image forming apparatus for displaying predetermined messages thereon.

Further, the trouble classifying device classifies reasons or causes why the trouble has occurred into a plurality of categories. Further, the trouble classifying device regards a trouble as urgent information if it causes the image forming apparatus to be inoperative.

Further, the trouble-classifying device regards a trouble as non-urgent information if it occurs during an operation mode not presently used by the operator. Further, a plurality of display controllers are respectively disposed in each of the image forming apparatuses for controlling the display corresponding to the trouble classified by the trouble classifying device.

Further, at least one of the plurality of display controllers controls the display to display predetermined messages indicating that urgent trouble information is being transmitted when the trouble is regarded as urgent.

Further, messages may be displayed on the display indicating that the trouble which has occurred is being transmitted to the central control apparatus.

Further, each of the image forming apparatuses includes a trouble sensor for sensing causes of trouble which may occur during an operation of the image forming apparatus, a trouble classifying device for classifying reasons or causes why a trouble is detected by the trouble sensor, and a trouble informing device for informing the causes of trouble to a data communication apparatus. In addition, the data communication apparatus sends urgent trouble information prior to non-urgent trouble information to the central control apparatus.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 12 is a table illustrating data including process codes, names of the processes and contents of the processes that are communicated between the central control apparatus and the image forming apparatus;

FIG. 13 is a table illustrating information codes, names of data and contents of the data which are communicated between the central control apparatus and the image forming apparatus;

DESCRIPTION OF THE PREFERRED EMBODIMENTS

Figure 1:
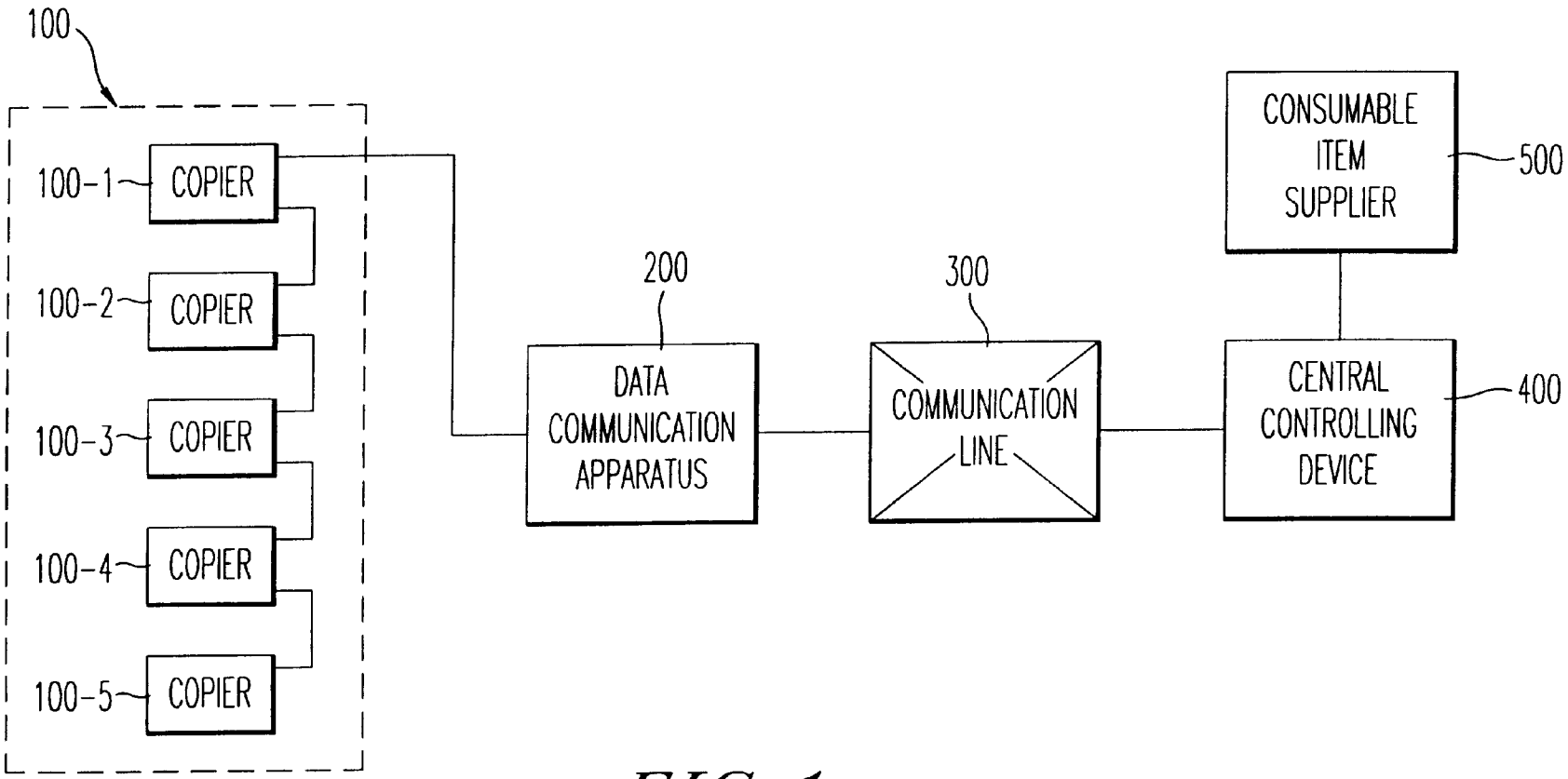
FIG. 1 is a block diagram illustrating one example of the remote diagnosis system of the present invention.

Referring now to the drawings, wherein like reference numerals designate identical or corresponding parts throughout the several views, and more particularly to FIG. 1, there is illustrated a remote diagnosis system according to the present invention. As illustrated in FIG. 1, the remote diagnosis system includes an image forming apparatus group 100, a data 20 communication apparatus 200, a communication line 300 and a central control apparatus 400. The image forming apparatus group 100 includes a plurality of image forming apparatus 100-1, 100-2, 100-3, 100-4 and 100-5, for example.

The data communication apparatus 200 is connected to the communication line 300, and transfers text data, for example, which is sent from the central control apparatus 400 to the image forming apparatus group 100. In addition, the data communication apparatus 200 transfers data generated by the image forming apparatus included in the image forming apparatus group 100 to the central control apparatus 400 through the communication line 300. The data communication apparatus 200 may be operating all day, thereby enabling communications between the central control apparatus 400 and the image forming apparatus group 100 even when the power of image forming apparatus group 100 is off.

Further, each of the image forming apparatus of the image forming apparatus group 100 and the data communication apparatus 200 are connected using a multi-drop connection configuration as shown in FIG. 1. Data communication between the image forming apparatus group 100 and the data communication apparatus 200 is executed by using a serial port in accordance with a data communications standard of RS-485, recommended by the electronic industries association (EIA). Further, the data communication therebetween is executed using a polling procedure in which each of the image forming apparatus is monitored to determine whether data to be transmitted exists therein and selecting which text data, for example, is transferred from the data communications apparatus 200 to the image forming apparatus group 100.

Figure 2:
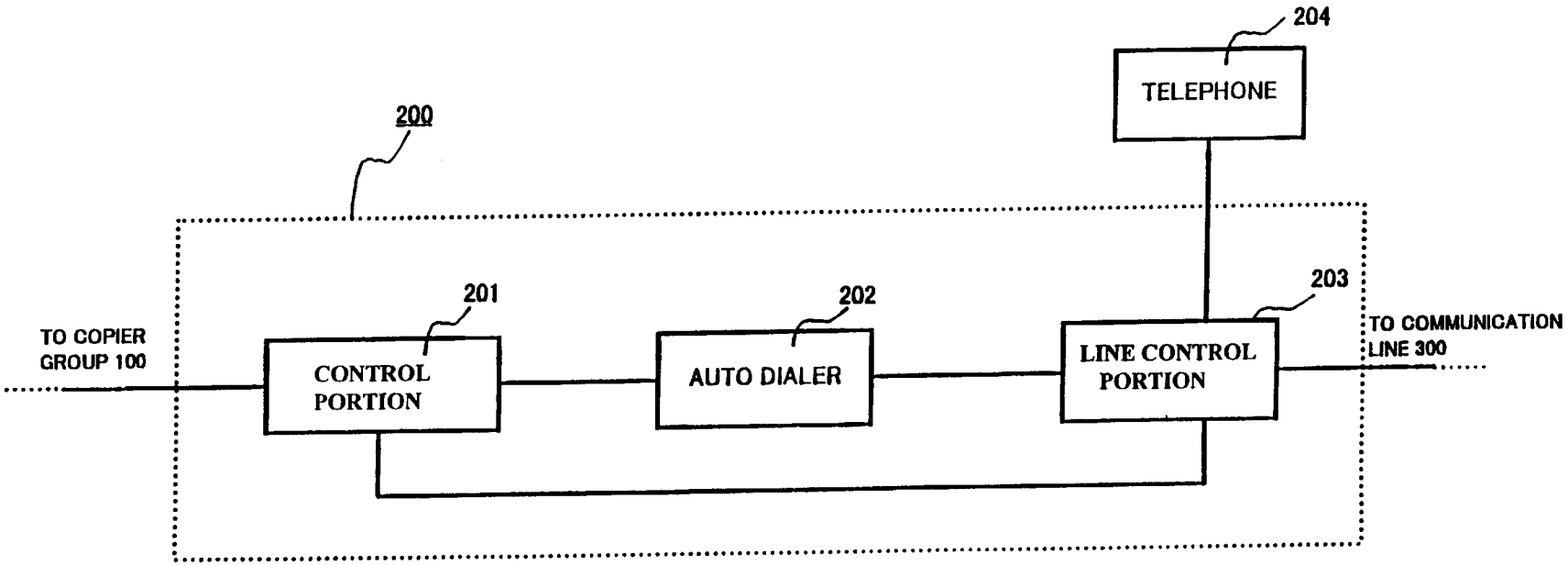
FIG. 2 is a block diagram illustrating a detail of a data communication apparatus included in the remote diagnosis system of FIG. 1.

As illustrated in FIG. 2, the data communication apparatus 200 includes a control portion 201, an auto-dialer portion 202 for automatically dialing a number of the central control apparatus 400 and a line control portion 203 for selectively connecting the communication line 300 with the image forming apparatus group 100 or a telephone 204.

The control portion 201 has a similar structure as a control device of an image forming apparatus illustrated in FIG. 5 which will be explained later in detail. Namely, the control portion 201 includes a ROM (read only memory) for storing a control program, a CPU (central processing unit) for executing the program by reading it from the ROM, a RAM (random access memory) for temporarily storing data, a non-volatile RAM (random access memory) backed up by a battery, a serial communications unit, an I/O (input and output) port, a real time clock for informing a current time and so on.

The non-volatile RAM stores communication data to be communicated between the central control apparatus 400 and the image forming apparatus group 100, including a plurality of device codes, a plurality of ID codes each for identifying one of the image forming apparatus included in the image forming apparatus group 100, a telephone number of the central control apparatus 400, data indicating recalling times in a case when a communication error has occurred between the data communication apparatus 200 and the central control apparatus 400, and data representing a recall interval for calls made by the data communication apparatus 200.

The remote diagnosis system has three basic functions that are described below. As a first function, the central control apparatus 400 controls the system to transfer instructional data from the central control apparatus 400 to the image forming apparatus group 100 by performing a selecting operation. As a second function, the central control apparatus 400 controls the system to transfer request and alarm data from the image forming apparatus group 100 to the central control apparatus 400 through the data communication apparatus 200 by performing a polling operation. As a third function, the data communication apparatus 200 uniquely controls each of the image forming apparatus by both the polling and the selecting operations.

According to the first function of the system, the below described data communications are executed. First, total copying counts counted by a predetermined image forming apparatus of the image forming apparatus group 100, copying counts for each of the copy sheet cassettes disposed in the image forming apparatus, copying counts for each of the different sized copy sheets used in the image forming apparatus, a total number of times miss-feedings have occurred on any of the copysheet feeding paths of the image forming apparatus, miss-feeding times per each of the different sized copysheets of the image forming apparatus and a number of times the miss-feedings occurred at a predetermined position on a copy sheet feeding path of the image forming apparatus are respectively read in order to control or reset the image forming apparatus during the above described data communications from the central control apparatus 400 to the image forming apparatus.

Second, a predetermined voltage amount, a current, a resistance and a process timing to be set to an image forming unit, or a developing unit, of the image forming apparatus are respectively set or read during the above described data communications from the central control apparatus 400 to the image forming apparatus. Third, messages are returned when request or alarm data made by the image forming apparatus is sent to the central control apparatus 400 during the above described data communications from the central control apparatus 400 to the image forming apparatus 100.

The above described plurality of data communications are executed by the data communication apparatus 200 by selecting one image forming apparatus from the image forming apparatus group 100 which is designated by the central control apparatus 400 when the data communication apparatus 200 receives a frame sent from the central control apparatus 400.

Figure 3:
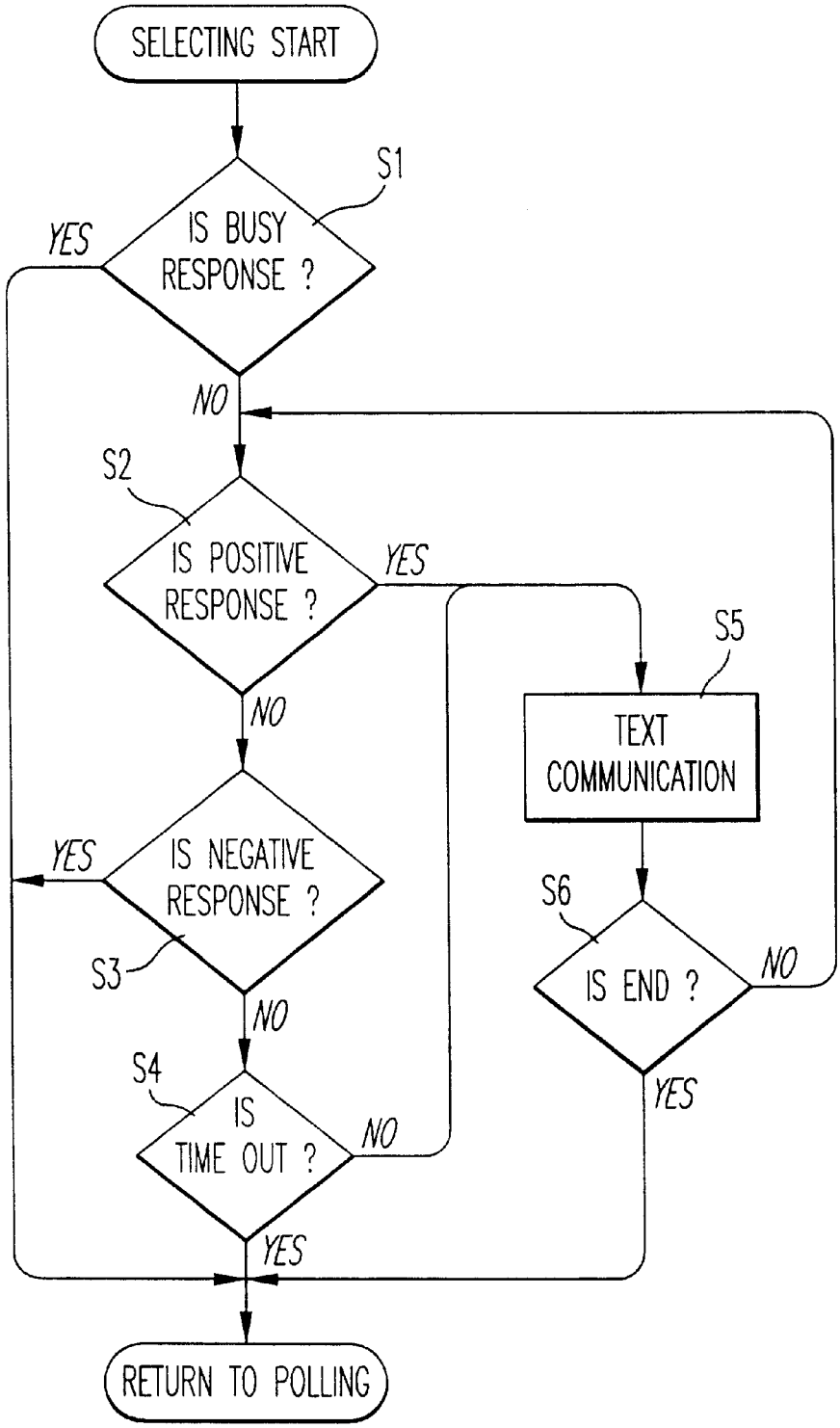
FIG. 3 is a flow chart illustrating how the data communication apparatus of FIG. 2 executes a selecting procedure for a single image forming apparatus.

In the selecting operation which is illustrated in the flow chart of FIG. 3, a predetermined image forming apparatus of the image forming apparatus group 100 is selected and data communications from the central control apparatus 400 to the selected image forming apparatus are then started. Each image forming apparatus of the image forming apparatus group 100 has a predetermined different device code. The data communication apparatus 200 outputs data including a predetermined code that indicates the selecting operation and a predetermined device code to the image forming apparatus group 100 using the RS-485 serial communications standard.

A predetermined image forming apparatus of the image forming apparatus group 100 determines if it is to be selected by comparing the device code which is added to the selecting code sent from the data communication apparatus 200. The device code is allocated to the image forming apparatus if its corresponding selecting code is included in the communication data.

The image forming apparatus outputs a busy response signal (step S1) that has at least predetermined code to the data communication apparatus 200, when the image forming apparatus has data to send to the central control apparatus 400. The data communication apparatus 200 stops the selecting operation and instead starts a polling operation described later in detail, when such a busy response signal exists therein.

The image forming apparatus designated by the central control apparatus 400 judges whether it is possible to be selected, or whether it is ready to receive data, when it has no data to send. Since the image forming apparatus is prohibited from writing data when it is in operation, it outputs an OK response signal (step S2), including at least a predetermined code, to the data communication apparatus 200 so as to start receiving data from the data communication apparatus 200 (steps S5 and S6).

The image forming apparatus outputs an Negative (NG) response signal (step S3) including at least a predetermined code to the data communication apparatus 200 so as to stop the selecting operation of the data communication apparatus 200. The data communication apparatus 200 also stops the selecting operation when the image forming apparatus designated by the central control apparatus 400 does not output either the OK response signal or the NG response signal within a predetermined time period after starting the selecting operation, which may occur when electrical power for the image forming apparatus is shut down, for example.

In the second function of the system, the below-described data communications are made from one image forming apparatus of the image forming apparatus group 100 to the central control apparatus 400. First, urgent data communications are made from the image forming apparatus to the central control apparatus 400 via the data communication apparatus 200 in order to inform a possibility of an accident or problem which has arisen in the image forming apparatus causing the image forming apparatus to be inoperative. Second, urgent data communications are made from the image forming apparatus to the central control apparatus 400 via the data communications apparatus 200 in order to transmit a consumable request when an operator inputs a signal indicative of requesting a new consumable article or a repair request when the operator inputs a signal indicative the image forming apparatus requiring repair. Third, urgent data communications are made from the image forming apparatus to the central control apparatus 400 via the data communication apparatus 200 in order to inform an event that a value of the image forming apparatus counter is near a predetermined amount. Fourth, non-urgent data communications are made at designated time intervals during a day, for example, from the image forming apparatus to the central control apparatus 400 via the data communication apparatus 200.

When a possibility of an accident or trouble that does not interfere a copying operation occurs in the image forming apparatus, the image forming apparatus informs the central control apparatus 400 of such possibility so as to prevent the accident beforehand. More specifically, at this time, the central control apparatus 400 will be informed of an event that the copy counter is a predetermined count which corresponds to, for example, a time for old parts to be replaced, predetermined use times when parts are regarded as needing replacement, and a predetermined maximum durable level at which the sensor does not function. The central control apparatus 400 previously sets the above-described designated time, and data thereof is stored in the data communication apparatus 200. However, data communications are made urgently as described above when the predetermined times of use for the portions, for example, have been completed. Fifthly, elapsing of the predetermined time starting from a first usage of the image forming apparatus is communicated as non-urgent data communications at the designated time in a day from the image forming apparatus to the central control apparatus 400 via the data communication apparatus 200.

The above described data communications are respectively executed using the polling operation and the selecting operation from the data communication apparatus 200. Such a polling operation is generally executed every time from the data communication apparatus 200 to each of the image forming apparatus of the image forming apparatus group 100 so that the data communication apparatus may receive data generated by the image forming apparatus and send the data to the central control apparatus 400.

Figure 4:
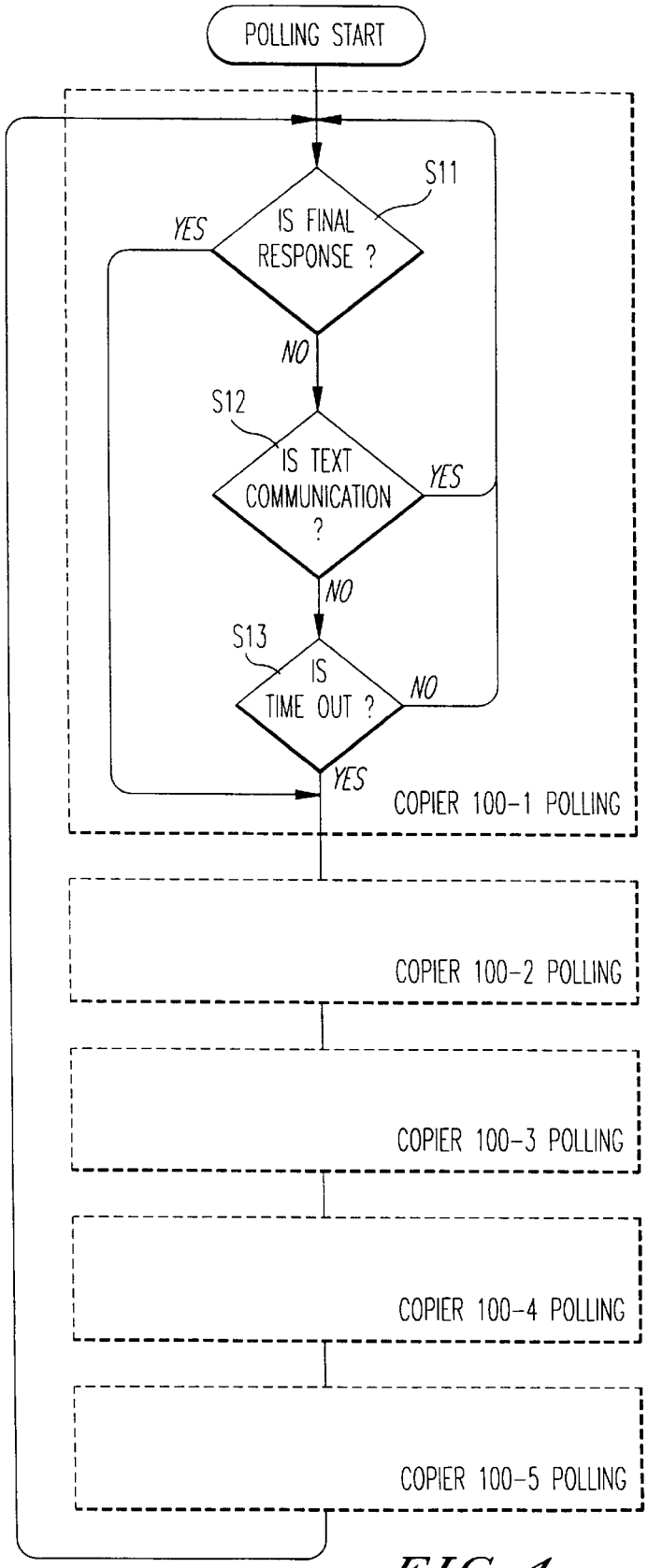
FIG. 4 is a flow chart illustrating how the data communication apparatus of FIG. 2 executes a polling procedure for a plurality of image forming apparatus.

The polling operation from the data communication apparatus 200, as illustrated in the flowchart of FIG. 4, is executed by designating one of the image forming apparatus from image forming apparatus 100-1 to 100-5 and checking whether each image forming apparatus has communications data to send to the central control apparatus 400. When the polling operation is executed, the data communication apparatus 200 sends the predetermined code data indicating the polling operation and a device code using the RS-485 standard serial data communications manner, for example.

Each image forming apparatus of the image forming apparatus group 100 compares its own allocated device code and the above-described device code sent from the data communication apparatus 200 during the polling operation. One of the image forming apparatus is recognized as being designated for the polling operation, when its device code accords with the device code sent from the data communication apparatus 200. Then, the designated image forming apparatus correspondingly starts outputting communication data to the central control apparatus 400 (step S12) including a code signal representing a consumables request, for example, when it needs to and stops such data communications when it has no communications data or it has completed the data communications by outputting a predetermined ending code.

To continue the polling operation, the data communication apparatus 200 designates a next image forming apparatus of the image forming apparatus group 100 upon receiving the ending code (step S11) from the previous image forming apparatus. Further, the data communication apparatus 200 stops the polling operation when a predetermined time elapses after the polling operation has started with respect to the designated image forming apparatus. More specifically, the data communication apparatus 200 stops the polling operation when the designated image forming apparatus does not return correspondence or outputs the ending code due to an event that an electrical power is not supplied to the image forming apparatus (step S13), for example. The polling operation is continuously executed to each of the image forming apparatus group 100 in a predetermined sequence until the selecting operation, which has a priority over the polling operation, is started.

In the third function of the system as described earlier and executed only by the data communication apparatus 200, the data communication apparatus 200 reads total counts from the designated image forming apparatus, and sends data indicating whether the data communications from the image forming apparatus are valid in response to such data communications.

The above-described reading of the total counts is executed at a predetermined time, for example, once at noon. However, if an electrical power source to be supplied to the image forming apparatus is off at the time, such a reading is executed only when the electrical power source is supplied again to the designated image forming apparatus.

The data communication apparatus 200 has first and second total counter memories therein for respectively storing data indicating total copy counts. Such total counts are read by the selecting operation as described above and are newly stored in the first total counter memory. The data of the total counts stored in the first total counter memory is renewed when new total counts are read and overwritten therein on a later day, unless the designated image forming apparatus is not used until the selected day such as Sunday, for example, when It the system is generally not used. The data lately stored in the first total counter memory is copied to the second total counter memory at the predetermined time on the selected day, for example. The central control apparatus 400 previously sets the time and the day and the data thereof is stored in a non-volatile RAM provided to the data communication apparatus 200.

The data communication apparatus 200 sends the data, indicating the total counts and which is stored in the second total counter memory, to the central control apparatus 400 in two different ways as described below. In a first way, the central control apparatus 400 accesses the data communication apparatus 200 to read the data at the predetermined time of the day after the total counts data is copied to the second total counter memory. In a second way, the data communication apparatus 200 sends the total counts data at the predetermined time of the day, after the data thereof is copied to the second total counter memory, to the central control apparatus 400 by automatically dialing a number of the central control apparatus 400. The time data for such a calling is previously set by the central control apparatus 400 and stored in the non-volatile RAM of the data communication apparatus 200.

Further, the data communication apparatus 200 has a plurality of other pairs of first and second memories. Such a plurality of other pairs of the first and second memories are used for different copy modes, including a mono-color copying mode, a full-color copying mode, an application copying mode, such as a facsimile mode and printer mode, and so on. The total counts data in each of the different copy modes is stored in the first total counter memory and then copied to the second total counter memory.

Figure 5:
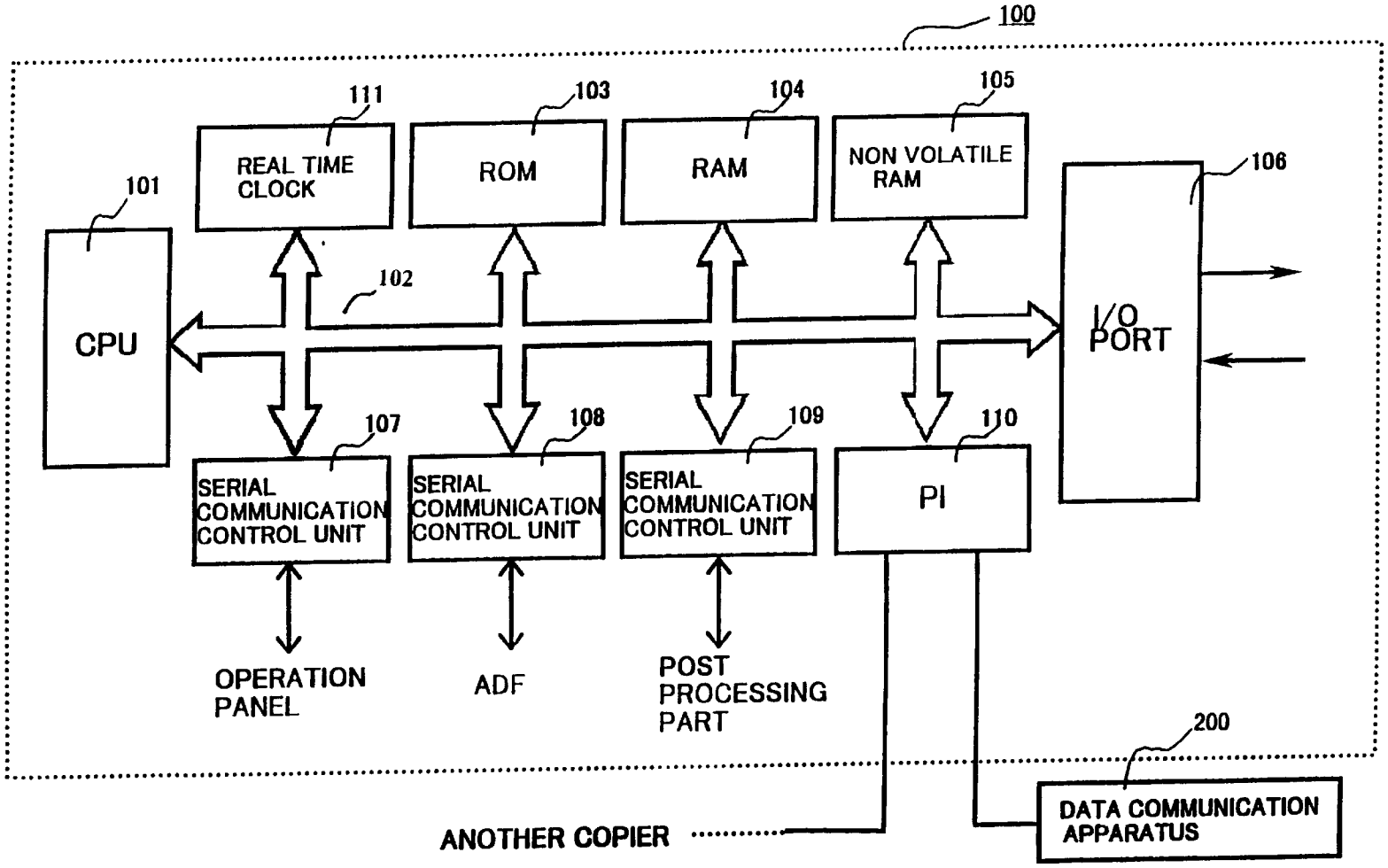
FIG. 5 is a block diagram illustrating a control device included in each of the image forming apparatus of the remote diagnosis system of FIG. 1.

A control device disposed in the image forming apparatus is shown in FIG. 5. As illustrated, the control device of the image forming apparatus included in the image forming apparatus group 100 includes a CPU 101 (central processing unit) for executing a copying control program that includes an address and data, a control bus 102, a ROM (read only memory) 103, connected to the CPU 101 through the bus 102, for storing a control program, a RAM (random access memory) 104 for storing data and a non-volatile RAM (random access memory) 105 for storing data even when an electrical power source for the system is shut down.

The control device further includes an I/O port 107 connected to the CPU 101 through the bus 102 for exchanging data with the data communications apparatus 200. The I/O port 107 is connected with a plurality of loads (not shown), such as a driving motor, a solenoid, a clutch, sensors and so on, each of which are used in the image forming apparatus. The control device further includes a plurality of serial communication control units 107, 108 and 109 for sending and receiving a signal with an operation indicating portion, a document feeding portion and a post processing portion of the image forming apparatus, respectively. The operation-indicating portion is explained later in detail referring to FIGS. 8, 9 and 10. However, an explanation for the document feeding and post processing portions is omitted because they are not new.

The control device further includes a personal interface (hereinafter referred to a P/I) 110 that is disposed between the CPU 101 and the data communication apparatus 200 and reduces work to be performed by the CPU 101. However, the P/I 110 may be omitted if the CPU 101 has a sufficient ability to perform for the P/I 110.

The P/I 110 performs various functions: monitoring the polling and selecting operations executed by the data communication apparatus 200; sending either an OK or NG response when the selecting operation is executed; judging whether data exchanged between the data communication apparatus 200 and the image forming apparatus 100 is correct; executing a parity check of a frame; requesting a resend of data when an error occurs in the data communications; and judging a header portion of the frame before it is sent.

The control device of the image forming apparatus further includes a real time clock 111 connected to the CPU 101 through the bus line 102, so that the CPU 101 is able to link its operation with a real time by reading the real time clock 111.

Figure 6:
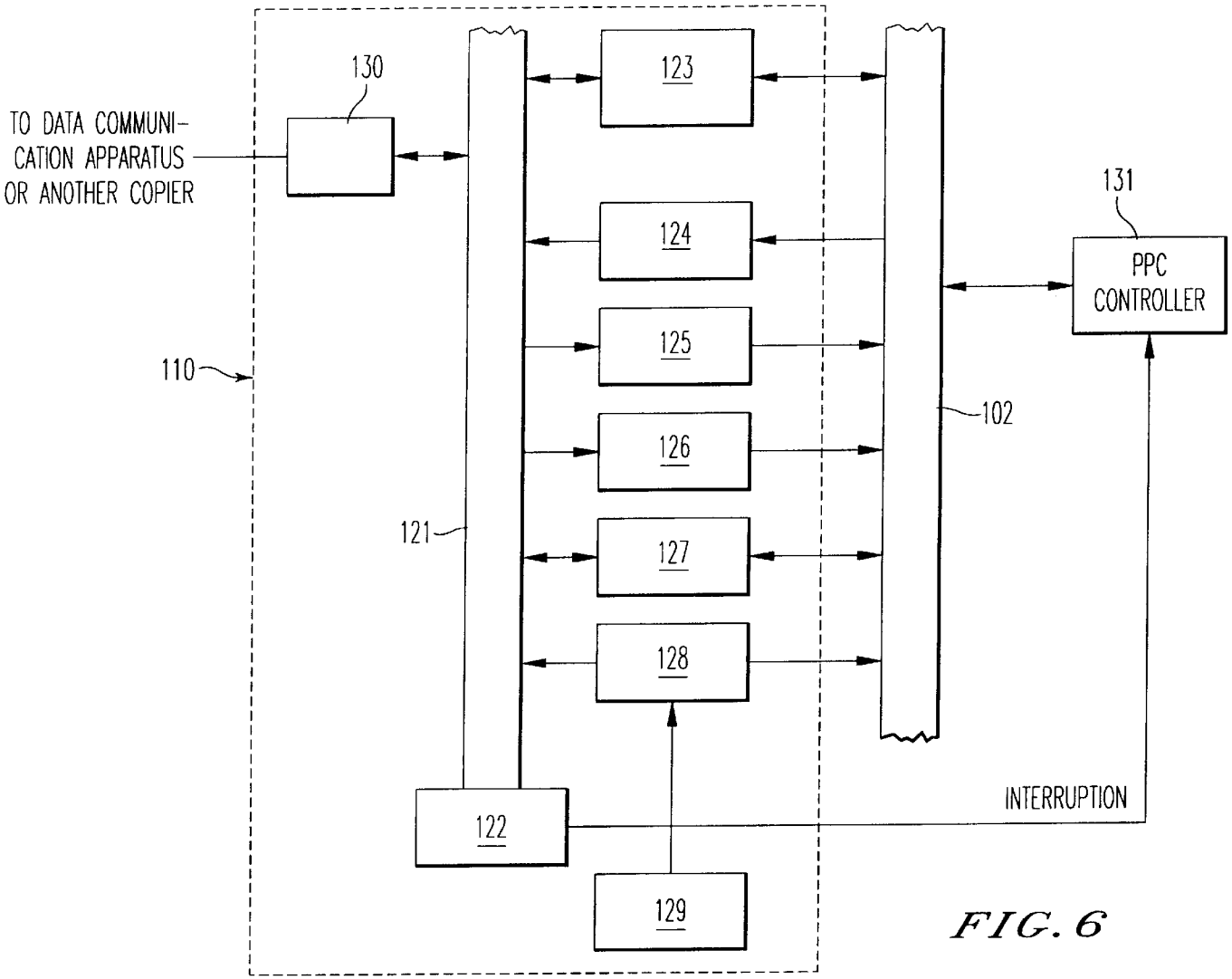
FIG. 6 illustrates a block diagram of a personal interface (P/I) disposed in each of the image forming apparatus shown in FIG. 5.

A control device of the P/I 110 is illustrated in the block diagram of FIG. 6 and includes a ROM (read only memory) (not shown), a RAM (random access memory) (not shown), a single chip CPU (central processing unit) 122 connected with the ROM and the RAM through a bus line 121, a dual port memory 123, a plurality of registers 124, 125, 126 and 127, an I/O (input and output) port 128 and a device code setting switch 129 connected with the I/O port 128.

The dual port memory 123 may be accessed by, for example, the CPU 122, which reads data stored therein, and the CPU 101 disposed in the P/I 110 and the image forming apparatus 100, respectively. The dual port memory 123 sends and receives text data to the P/I 110 and the image forming apparatus 100. The plurality of registers 124, 125, 126 and 127 are used while the text data is sent or received.

The device code setting switch 129 sets a plurality of different device codes that identify the image forming apparatus. As described earlier, each of the device codes is used when the data communication apparatus 200 executes the polling or selecting operation. The control device of the P/I 110 further includes a serial communications control unit 130 that is connected with the data communication apparatus 200 via a line and/or a P/I 110 of other image forming apparatus of the image forming apparatus group 100. The PPC controller 131 indicates all of the units illustrated in FIG. 5.

Hereinbelow, a structure of the above-described operation-indicating portion of the image forming apparatus is explained in detail referring to several drawings. The operation-indicating portion 141, shown in FIG. 7, includes similar control devices that are included in the image forming apparatus illustrated in FIG. 5. The operation indicating portion 141 includes a ROM (read only memory) for storing a control program, a CPU (central processing unit) for executing the program by reading the program from the ROM, a RAM (random access memory) for temporarily storing data, a serial communications unit and an I/O (input and output) port. The operation-indicating portion 141 sends and receives data to and from the serial communications unit 107 disposed in the image forming apparatus as described above.

The operation-indicating portion 141 further includes various devices as described below. A display 142 for displaying a plurality of messages for a plurality of copying modes is disposed on the operation-indicating portion 141. A contrast amount key 143 for changing a contrast of the display 142 is disposed thereon adjacent to the display 142. A display mode switch 155 for switching a display from a copying mode display to a consumables request mode display when it is depressed is disposed adjacent to the display 142. A mode reviewing key 144 for displaying the selected modes already set to the operation indicating portion 141 on the display 142 when it is depressed, a menu or message changing key 145 for changing menu or messages to be displayed on the display 142 from a beginners menu or message to an expert's menu or message when it is depressed, a program calling key 146 for calling a user program when it is depressed, a user program register key 147 for registering a user program when it is depressed, a guidance key 148 for displaying guidance in the display 142 and so on are respectively disposed adjacent to the display 142 on the operation indicating portion 141.

Further, a print switch 149 is also included for starting a copy operation when it is depressed, a ten key 150 for inputting numbers to be copied, for example, a set number clear and copy stop key 151 for either clearing preset numbers or to stop the copy operation when it is depressed, a confirming key for confirming both a magnification set by an operator using a zoom mechanism and a margin of a copy sheet set by an operator, an interruption copy key 153 for interrupting the copy operation when it is depressed and a preheat and mode clear key 154 for respectively preheating a fixing roller and clearing a preset mode. These components are respectively disposed adjacent to the display 142 on the operation indicating portion 141.

The display 142 is constructed as a full dot displaying element, for example, a liquid crystal, a fluorescent material and includes a matrix touch-sensing-panel overlaid on the full dot displaying element.

Figure 8:
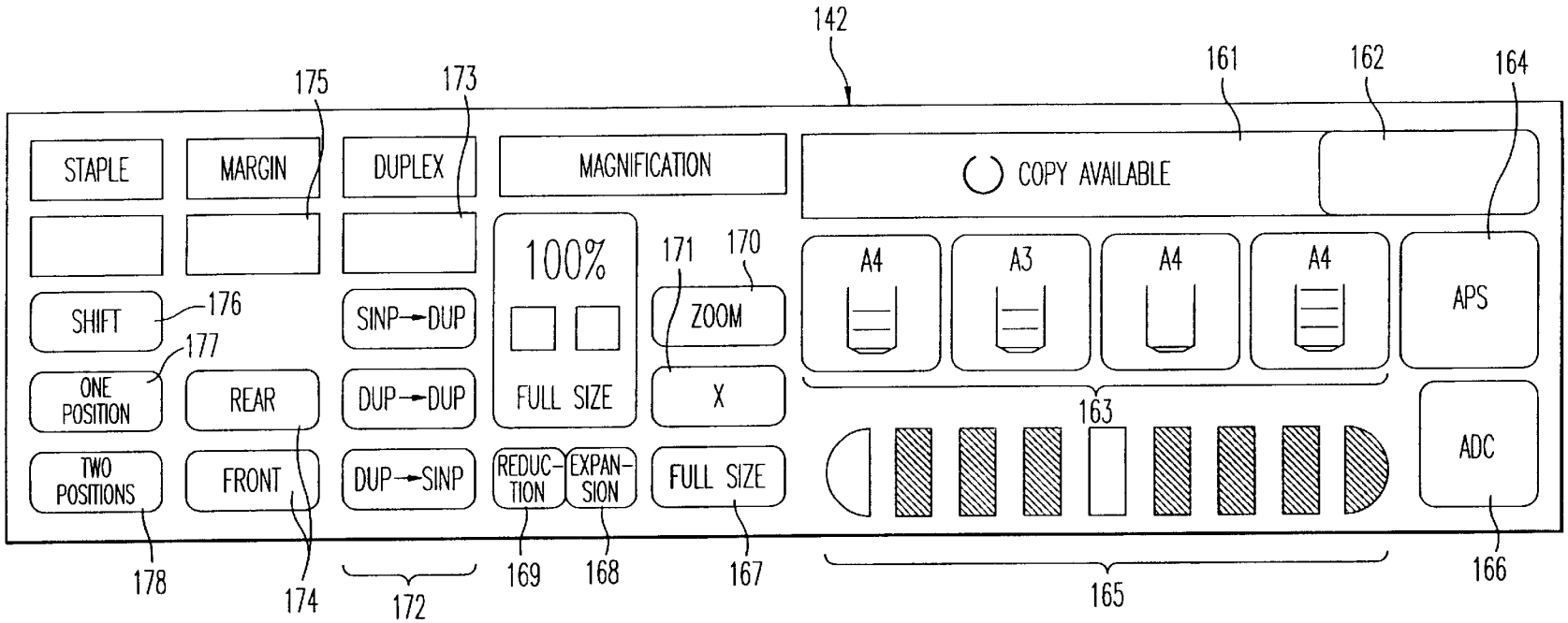
FIG. 8 illustrates messages, used in a copy mode, which are displayed on a portion of the operation panel illustrated in FIG. 7.

Hereinbelow, the display 142 is explained in more detail referring to FIG. 8. A display for setting a plurality of copy modes is illustrated in FIG. 8. As illustrated in FIG. 8, a message display portion 161 is formed to display messages used in the copy mode, for example, copy is acceptable?, replenish copy sheets? and so on. Further, a copy number displaying area 162 is formed next to the message display portion 161. A copy information portion 163 which includes a plurality of tray selecting areas for selecting a desired tray from a plurality of trays, a plurality of displaying areas representing different copysheet sizes and a plurality of displaying areas representing a state of remaining copy sheets are disposed below the message display portion 161. Also included is an auto paper selecting mode (APS mode) setting key 164 for automatically selecting a copy sheet having a predetermined size corresponding to a document size and/or a magnification when it is depressed.

A density adjusting key area 165 for manually setting a desired density to the operation indicating portion 141 by touching thereof is formed below the copy information portion 163. An auto density control key area 166 for automatically setting a predetermined density range referring to a background density level on a photo-conductor when developed, not shown, is also formed therein beside the density adjusting key area 165. A full-size copy setting key area 167, an enlarge key area 168 and a reduction key area 169 are formed on a left side of the density adjusting area 165 for optionally using when a desired variety of copies are made. A zoom magnification key area 170 for setting a magnification ranging from 64% to 142%, for example, is also formed therein at a left side of the copy information portion 163.

An auto magnification setting area 171 for automatically setting a predetermined magnification of the selected copy sheet size when depressed is formed below the zoom magnification area 170. A duplex copying mode selecting area 172 for setting one of the duplex modes is also formed therein. Such duplex modes include a first duplex-copying mode where a duplex copy is made from a duplex document and a second duplex-copying mode where a simplex copy is made from the duplex document. In addition, a duplex copying mode message area 173 for displaying a selected duplex mode with an icon indicative thereof is formed above the duplex copying mode selecting area 172.

Further, a margin setting area 174 is formed therein at a left side of the duplex copying mode selecting area 172. Such a margin setting area 174 is enabled to set a margin from 0 mm to 21 mm, for example, at one edge of the copysheet. When the margin setting area 174 is depressed to set a margin, the margin of the copysheet set is displayed on a margin displaying area 175 in the display 141. Further, a shift function selecting area 176, a one-position stapling key 177 and a two-position staple key 178 are respectively formed therein.

Hereinbelow, a frame to be communicated between the central control apparatus 400 and the data communication apparatus 200 is explained in detail referring to the drawings. Firstly, a first type frame structure is explained referring to FIG. 9. A plurality of the first type frames are generally communicated therebetween and accordingly a plurality of sequential numbers are respectively put thereto. Therefore, each of the sequential numbers represents a communications frame number. Namely, a number 01 is put to the first frame, and increased numbers are respectively put to the following frames. Such numbers increase until 99 and complete at 00.

The Frame has text data therein including an ID code, a distinction code and an information record. The ID code identifies both the data communication apparatus 200 and one of the image forming apparatus in the image forming apparatus group 100. The distinction code includes a code for indicating an object of a communication (hereinafter referred to processing code), a sender's code and a recipient code.

Such a distinction code is predetermined referring to a table as illustrated in FIG. 12. The information record includes an information code, a data portion and a digit portion-indicating digits of the data portion. The information record is predetermined referring to a table as shown in FIG. 13. A plurality of semicolons as data separators, for example, are respectively inserted among the ID code, the distinction code and the information record.

Figure 10:
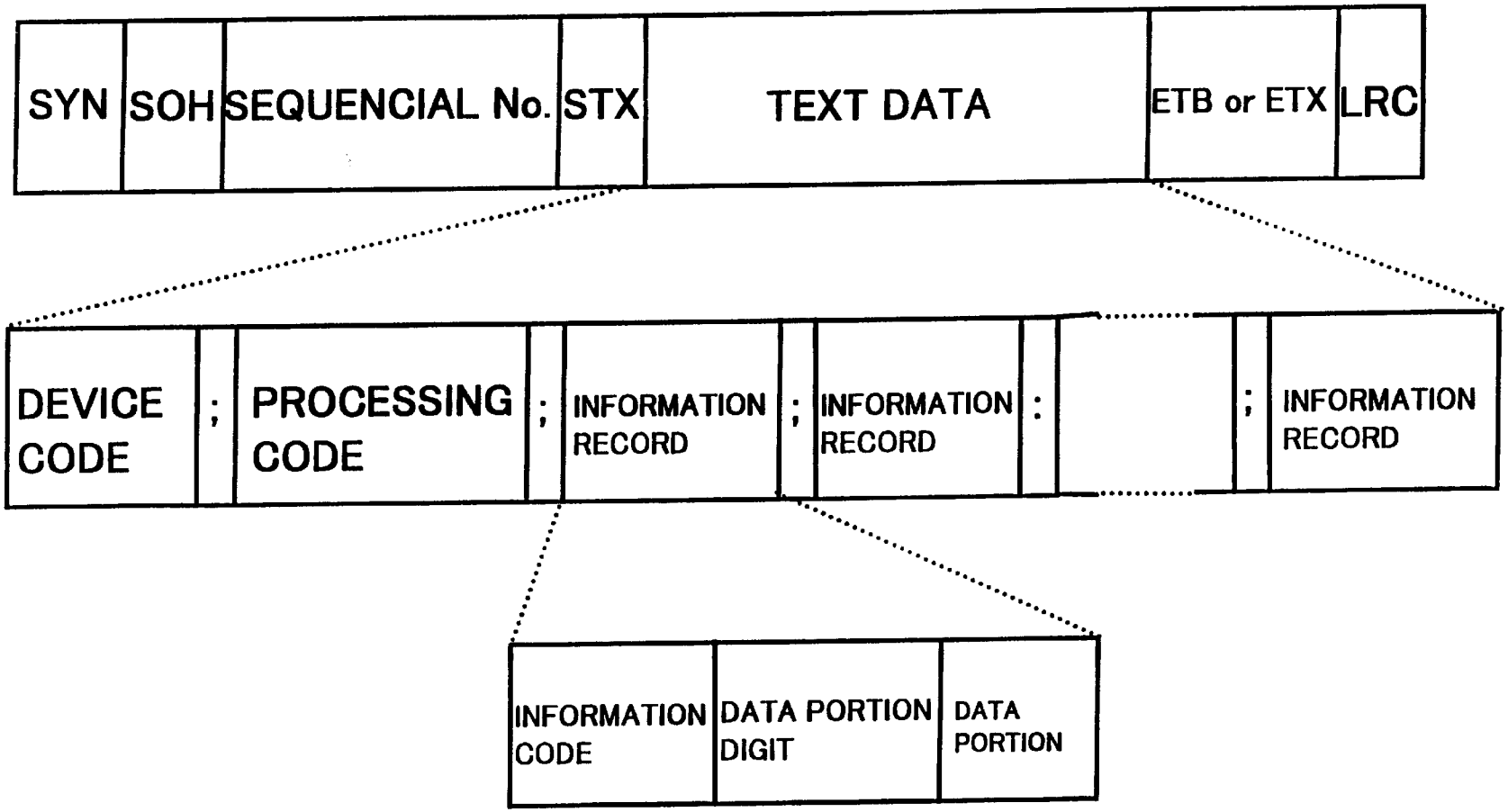
FIG. 10 illustrates a content of text to be communicated between the personal interface (P/I) and the data communication apparatus.

A second type frame which is to be communicated between the data communication apparatus 200 and the P/I 110 of the image forming apparatus is illustrated in FIG. 10. A device code for identifying a communications desired device is put in the frame. As described earlier, a plurality of device codes set by the operator using the device code setting switch 129, as shown in FIG. 6, are respectively read out from each of the image forming apparatus and respectively stored in the non volatile RAM of the data communication apparatus 200. The device codes stored in the non-volatile RAM are selectively decoded to fewer or larger codes to be used either as data communications between the image forming apparatus and the data communication apparatus 200 or data communications between the central control apparatus 400 and the image forming apparatus corresponding to a sending direction of the frame.

Figure 9:
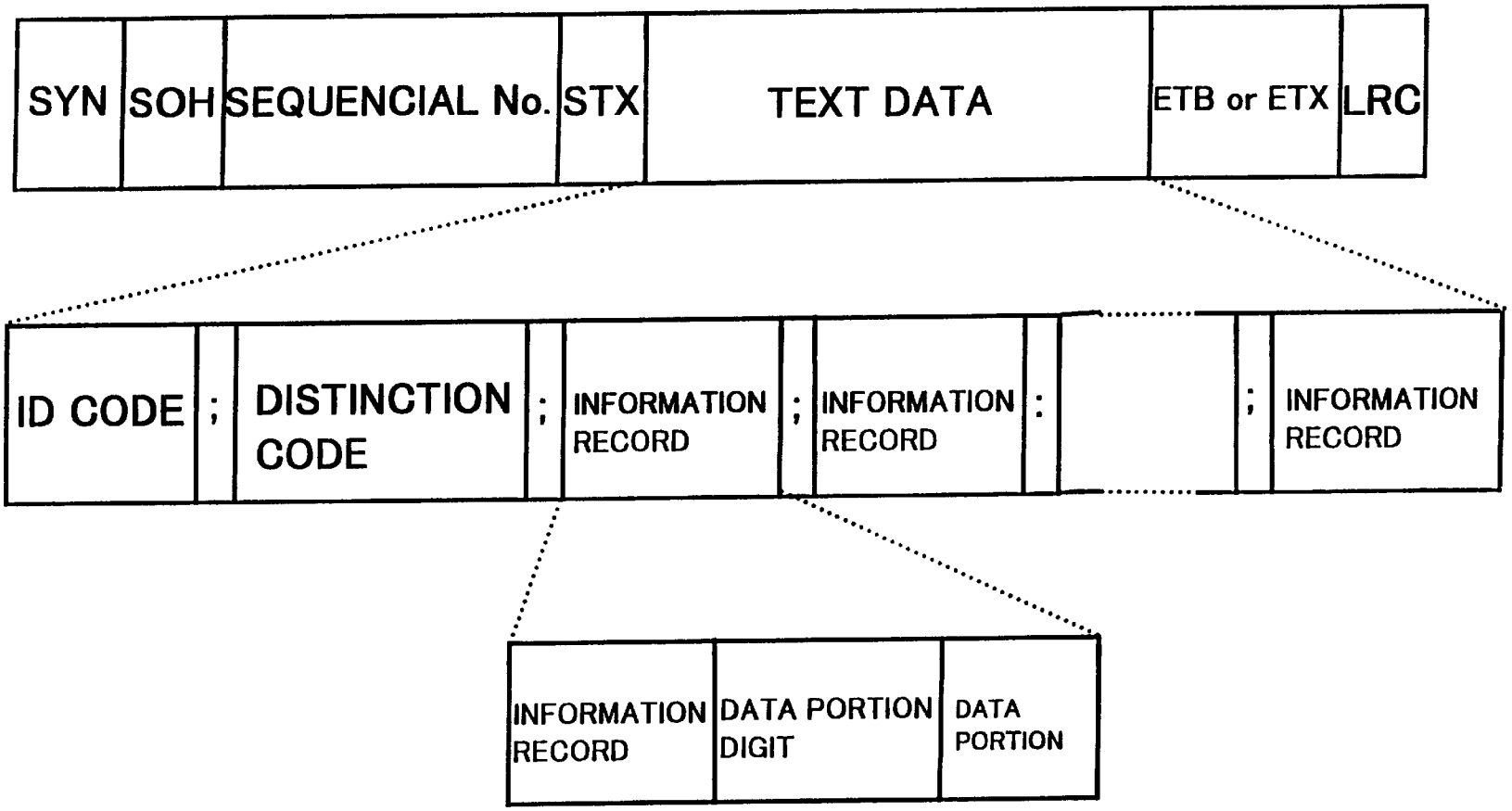
FIG. 9 illustrates a structure of a frame to be communicated between a central control apparatus and the data communication apparatus.

The processing code put in the frame represents a type of an object of the communications as described above and is constructed by deleting both a sender's and a recipient's code from the distinction code shown in FIG. 9. Such codes are selectively put and deleted therefrom depending on a sending direction of the frame.

Figure 11:
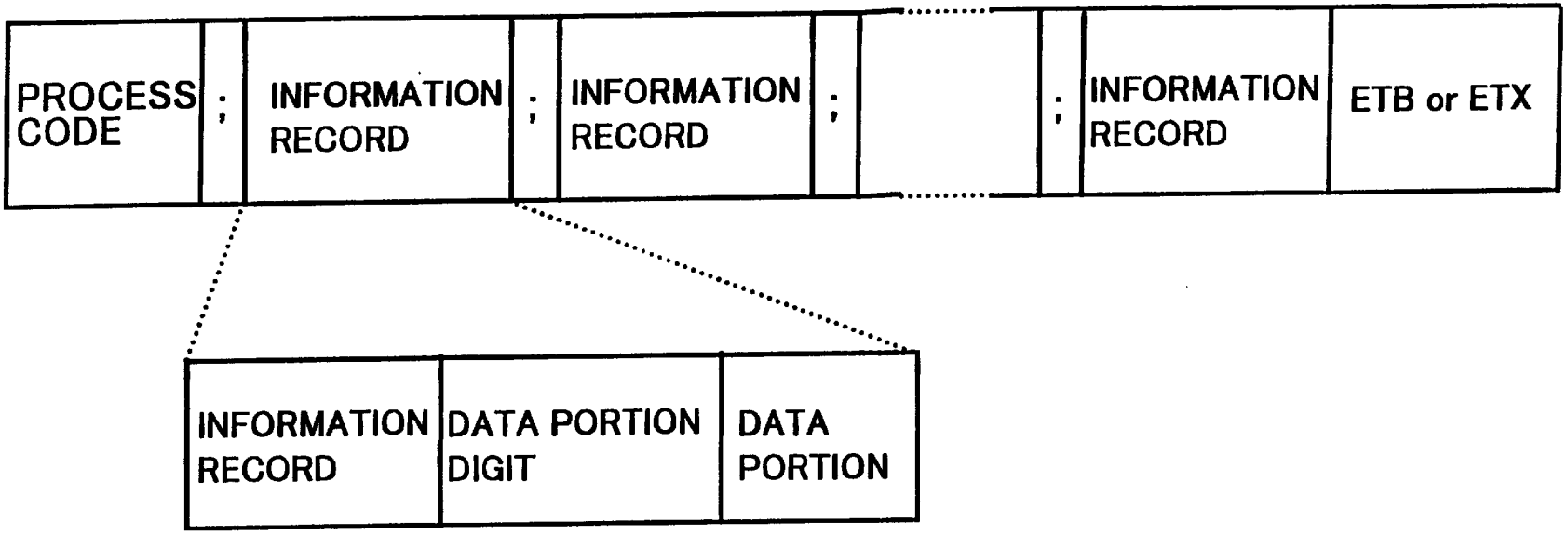
FIG. 11 illustrates a structure of a frame to be communicated between the personal interface (P/I) and the image forming apparatus.

A third type frame, which is to be communicated between the P/I 110 and the image forming apparatus, is illustrated in FIG. 11. Text in the third type frame is constructed by deleting the header, the device code and a parity portion as generally used in the second type frame shown in FIG. 10.

Hereinbelow, a plurality of control types for a display and an image forming process of the image forming apparatus using the above-described remote diagnosis system of the present invention is explained in detail. A plurality of matters are generally considered, when a plurality of types of data are sent from each of the image forming apparatus 100-1 through 100-5 to the central control apparatus 400 via the data communication apparatus 200. For example, how the display 142 displays messages to inform a data communication status to the user, when some data related to an image forming apparatus problem is sent to the central control apparatus 400 from one of the image forming apparatus, needs to be determined. Further, a timing for sending the data from the image forming apparatus to the central control apparatus 400 and how a safety-arrival of the data from the image forming apparatus to the central control apparatus 400 is judged are also to be determined. Thus, the below-described functions are provided in the present invention.

Some messages may be displayed to the user on the display 142 in two different ways. Firstly, a plurality of messages for an image forming process of the image forming apparatus, magnification messages, for example, which are currently used by the user, can be continuously displayed without regard to a fact that some trouble has occurred and data related to the trouble are sent to the central control apparatus 400, in a first display mode (a-1).

Secondly, some messages may be displayed thereon by changing the messages previously displayed and indicate that data related to the trouble are on the way of automatically being sent to the central control apparatus 400, in a second display mode (a-2).

Further, the data related to the causes of trouble are sent from the data communication apparatus 200 to the central control apparatus 400 in two different ways. Firstly, the data may be sent shortly after an event to quickly inform the central control apparatus the event has occurred in the image forming apparatus in a quick-communication mode (b-1). Secondly, the data sent from each of the image forming apparatus is stored in a memory of the data communication apparatus 200 and may be sent to the central control apparatus 400 once during a predetermined time in a day without regard to a time when an event to be informed thereto occurs, in a normal communication mode (b-2).

In the above described data communication, all data related to the trouble which occurred in each of the image forming apparatus is quickly sent to the data communication apparatus 200 from each of the image forming apparatus in trouble and this data is to be stored therein or is directly sent to the central control apparatus 400.

There are three ways of judging the successful arrival of the data sent from the image forming apparatus to the central control apparatus 400 via the data communication apparatus 200. The safe arrival can be automatically displayed on the display 142 in a first information mode (c-1). The safe arrival may be displayed, if the user depresses a predetermined key, not shown, in a second information mode (c-2). Lastly, the safe arrival may not be displayed on the display 142, since the user does not require such information due to a predetermined reason in a third information mode (c-3).

According to the first embodiment of the present invention, when some trouble occurs which causes an image forming process to be inoperative, data indicative of the trouble is quickly sent to the central control apparatus 400 from the data communication apparatus 200 as urgent trouble information and the system correspondingly operates in the above described modes a-2, b-1 and c-1. If a function, for example an ADF function, is related to the problem and another function, for example a manual document setting function, is used by the user, since an image forming process using the another function is operative, the system is controlled to operate in the above described three modes a-1, b-1 and c-2.

When the user makes a repairing request or a consumable item request by using the display 142 which serves as an input key, generally called a touch panel, for inputting and generating request data, the request data indicative of either the repairing request or consumable item request is quickly sent to the central control apparatus 400 via the data communication apparatus 200 as urgent (trouble) information in the modes a-2, b-1 and c-1. Further, when a copy counter disposed in the image forming apparatus for counting a number of copysheets completes a predetermined level, data indicative of completion of counting the number is quickly sent to the central control apparatus 400 as urgent information in the modes a-1, b-1 and c-3.

When predetermined times of copying operations are completed and parts or a sensor each employed in the image forming apparatus reach a level which they need to be changed or a predetermined period of time after the image forming apparatus is first used almost ends, each of which allows the user to continuously use the image forming apparatus and requires preservation thereof, data indicative of this is sent to the central control apparatus 400 as non-urgent information at a predetermined time in a day in the modes a-1, b-2 and c-3.

Further, when times of copying operations reach a predetermined level within a predetermined period of time after the image forming apparatus is first used, data indicative of the predetermined level has been reached is sent to the central control apparatus 400 from the 1data communication apparatus 200 as non-urgent information in the modes a-1, b-2 and c-3.

Figure 14:
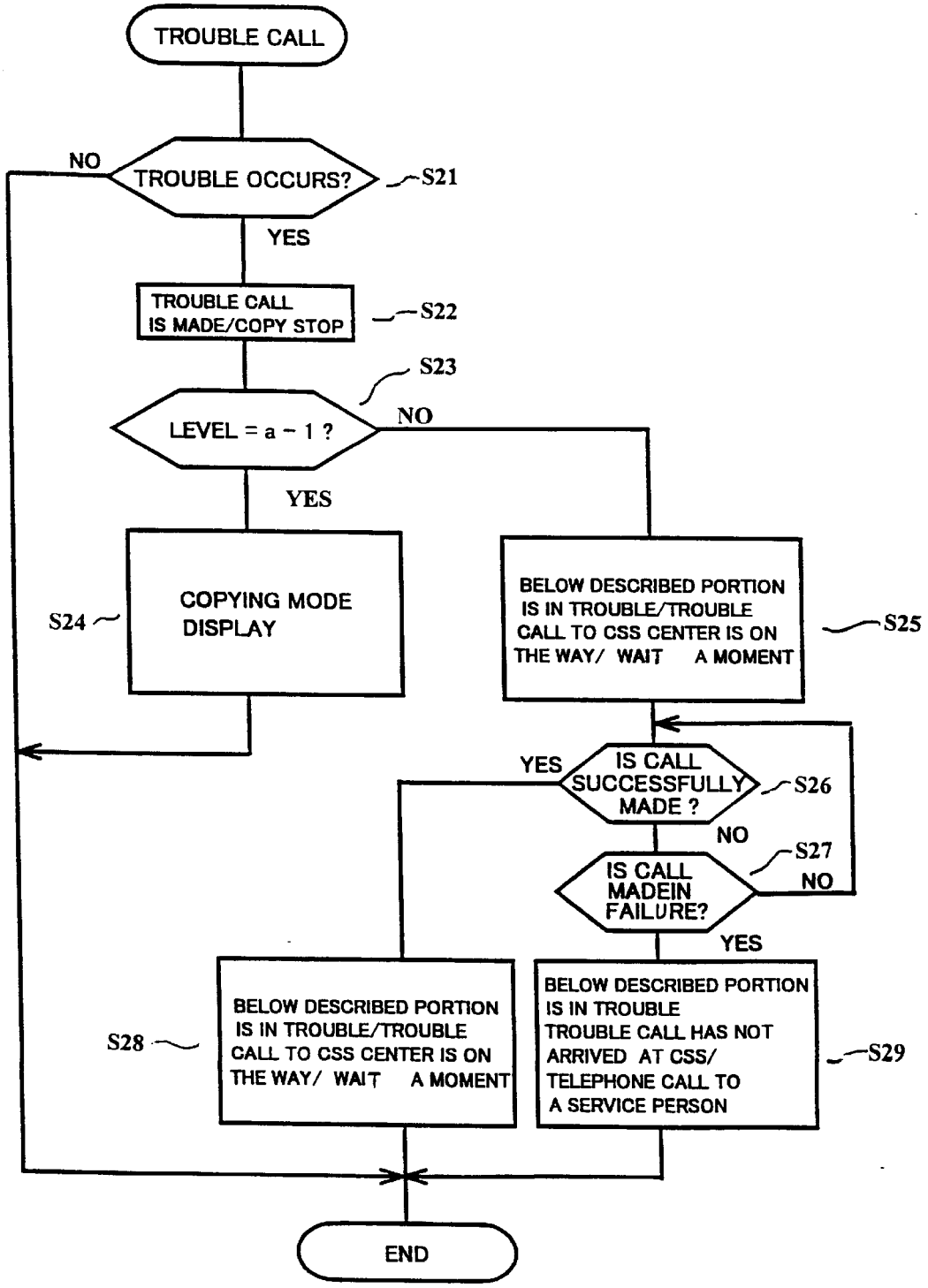
FIG. 14 is a flow chart illustrating data communication and a control of a display when data including trouble information is automatically sent to the central control apparatus.

The above described data communications process is explained by using a flow chart referring to FIG. 14. When each of the image forming apparatus 100-1 through 100-5 detects a problem which needs to be transmitted (Step 21), the trouble is transmitted to the central control apparatus 400 by sending data indicative thereof through the data communication apparatus 200 and the communication line 300(Step S22).

Figure 7:
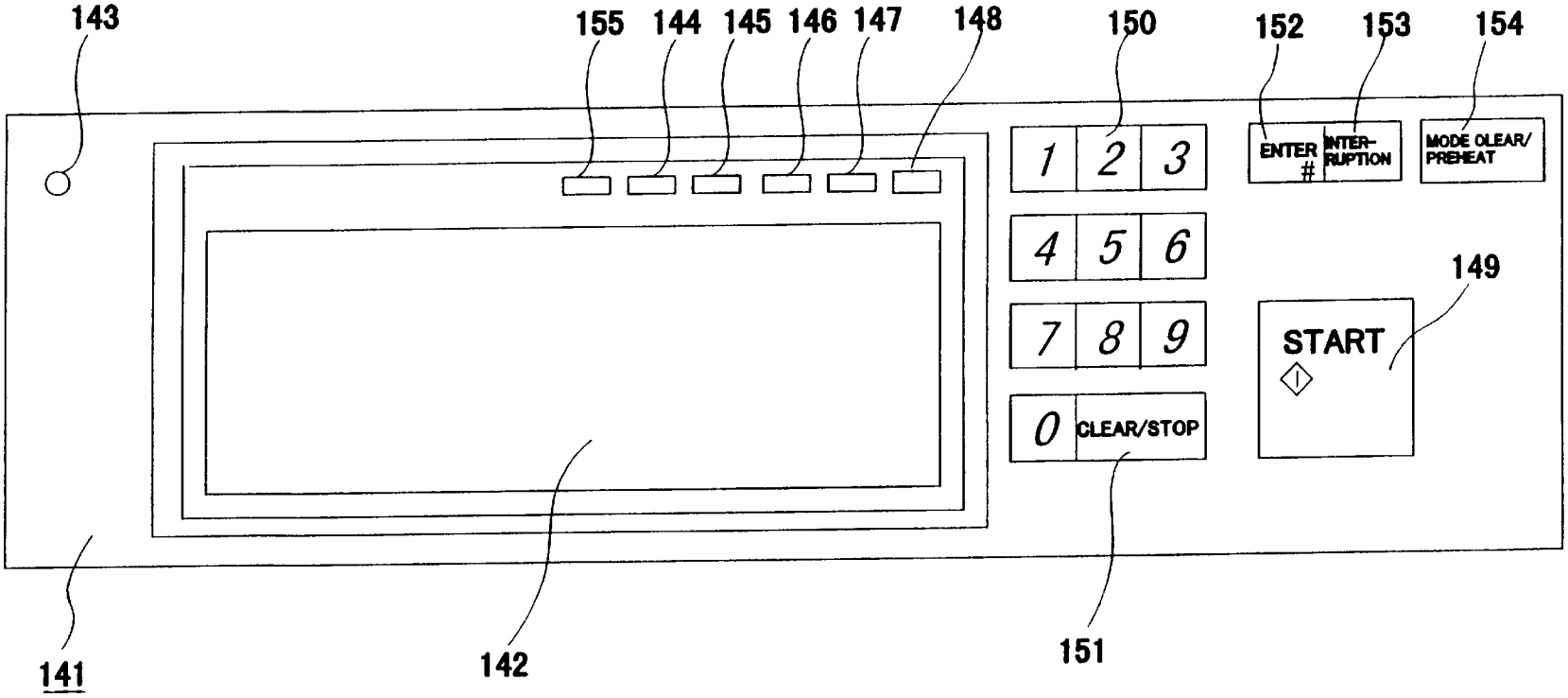
FIG. 7 is a plane view illustrating an operation panel of an image forming apparatus.

Each of the causes of trouble are classified in to two categories corresponding to the above-described modes a-1 and a-2 in Step S23. If the trouble corresponds to the mode a-1, the display 142 as illustrated in FIG. 7 is controlled to continuously display messages for the image forming process and the image forming apparatus is controlled to complete such a process (Step S24). Thus, the user does not recognize the trouble, since he or she does not require knowing the trouble when continuing the desired copying operation.

If the trouble, on the other hand, corresponds to the mode a-2, the display 142 is controlled to display messages indicating that data about the trouble is on the way of being automatically sent to the central control apparatus 400 to notify the trouble to the user (Step S25). Whether or not the data indicating the problem safely arrives at the central control apparatus 400 is detected in Steps S26 and S27. The above described detection results are displayed using predetermined messages on the display 142 (Steps S28 and S29). Thus, the user is enabled to correspondingly take an appropriate action related to the messages as shown in the Steps S28 and S29.

Figure 15:
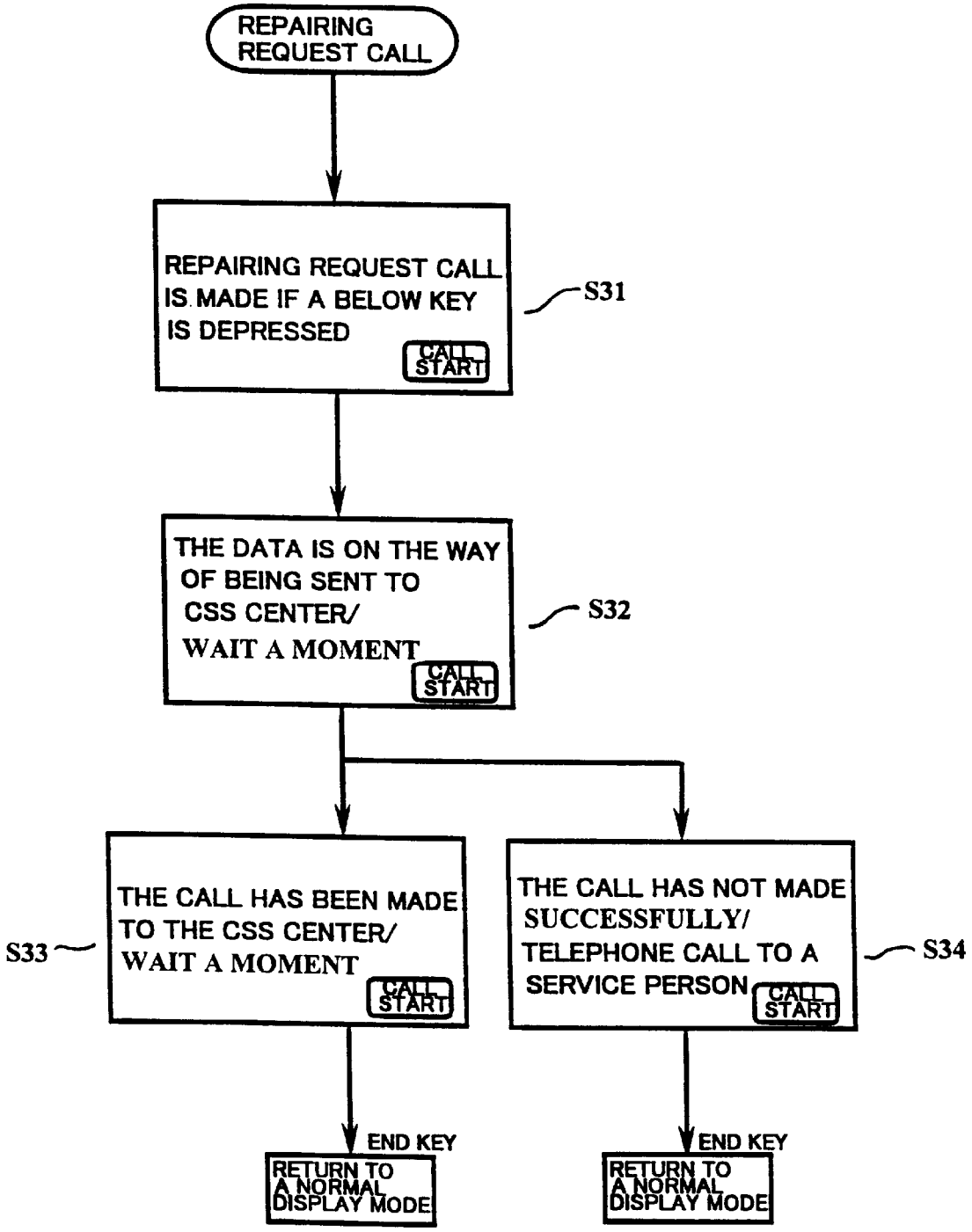
FIG. 15 is a flow chart illustrating control of a display when data communications related to a service person call are executed between the central control apparatus and one of image forming apparatus of the present invention.

A plurality of message types are displayed on the display 142 during the repairing request mode in a similar manner as the mode a-2 described below. A control of the display 142 when the user performs a repairing request is explained referring to FIG. 15. When the user depresses a repairing request key disposed on the display 142, the display 142 displays messages indicating that an auto repairing call is made when a repairing key formed thereon is depressed (Step S31).

When the repairing key is depressed, the display displays messages indicating that the repairing request is on the way of being sent to the central control apparatus 400 (Step S32), and data indicating this repairing request is sent from the image forming apparatus in trouble to the central control apparatus 400 via the data communication apparatus 200. If such data communication is successfully completed, the display 142 displays messages indicative of such a result (Step S33). If data communication is unsuccessfully completed, the display 142 displays messages indicative of such a result (Step S34). The messages displayed in the display 142 are changed to that for the image forming process when an end key, not shown, is depressed.

The above-described repairing request is manually made in general by depressing a repairing request key, not shown, in the above-described embodiment, for example. The ten keys 150 as illustrated in FIG. 7 may be used for the repairing request key by depressing the keys in combination thereof to generate a predetermined signal.

According to the second embodiment of the present invention, each occurring problem in each of the image forming apparatus 100-1 through 100-5 is classified by a trouble classifying device into at least two categories including urgent information to be urgently displayed on the display 142 and non-urgent information not to be urgently displayed thereon. When a problem corresponding to the non-urgent information occurs, a controller of the image forming apparatus controls the image forming process to stay operative and controls the display 142 to continuously display messages thereon for the image forming process. When a problem corresponding to the urgent information occurs, the controller controls the display 142 to display messages indicating that the data corresponding to the problem is on the way of automatically being sent to the central control apparatus 400, since some image forming process is inoperative. This data is sent from the image forming apparatus to the central control apparatus 400 via the data communication apparatus 200.

Such causes of trouble corresponding to the non-urgent information are described below, for example. A first example is a case where a function not presently in use develops trouble. A second example is a case where a predetermined total copy number has been copied. A third example is a case where predetermined operational times for parts of the image forming apparatus have been reached or a timer has counted a predetermined time period or a sensor has achieved a predetermined maximum duration level, each of which requires preservation. A fourth example is a case where an actual usage of the image forming apparatus reaches a predetermined maximum time period for a user who contracted only to use the device within the specified period of time.

A plurality of causes of trouble to be classified as urgent information are described below. A first urgent trouble is a case where an image forming process of the image forming apparatus is inoperative due to some trouble. A second urgent trouble is a case where a user requests consumables to the central control apparatus 400 or calls a service person to repair the image forming apparatus. Such a call or request is finally sent to the central control apparatus 400 in a manner as described above referring to the drawings of FIGS. 14 and 15.

According to a third embodiment of the present invention, a plurality of controllers are respectively disposed in the image forming apparatus 100-1 though 100-5. Each of the controllers classifies causes of trouble occurred therein in a manner that if a predetermined function is in trouble and is not actually used, the controller regards the trouble as a non-urgent, and if the function is actually used, it regards the trouble as urgent by referring to the table in the ROM.

The controller controls the image forming apparatus to continuously execute an image forming process and the display 142 to continuously display messages for the image forming process thereon, when the non-urgent trouble occurs. To the contrary, the controller controls the image forming apparatus to stop it's operation and controls the display 142 to display messages thereon indicating that the trouble information data is on the way of being automatically sent to the central control apparatus 400, for example, when the urgent trouble occurs.

Figure 16:
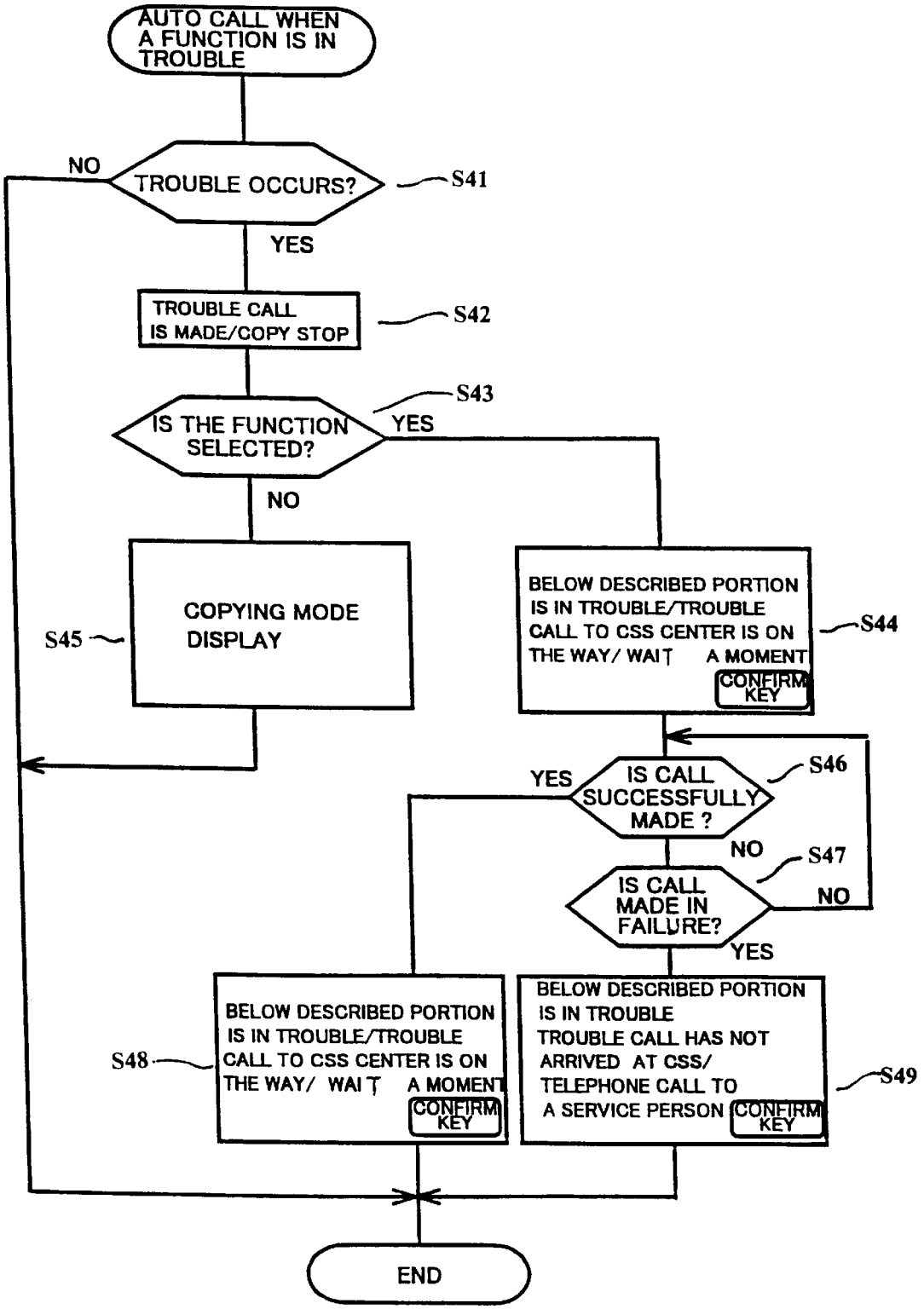
FIG. 16 is a flow chart illustrating control of a display when a function presently used by a user develops trouble.

The above-described predetermined function may be an ADF (auto-document feeder) and a duplex copy. One of plurality of examples is illustrated by a flow chart in FIG. 16, where data communications are automatically made when the predetermined function of each of the image forming apparatus is inoperative.

For example, if some trouble occurs (Step S41) in a duplex mode and the user presently operates the image forming apparatus in this mode, the controller regards it as an urgent problem and automatically sends data indicative of the urgent problem to the central control apparatus 400 via the data communication apparatus 200 (Step S42 and S43), since this mode should not be used by the user. At the same time, the controller stops an operation of the image forming apparatus and controls the display 142 to display messages indicating that the urgent trouble is on the way of being transmitted to the central control apparatus 400 (Step S44) to notify the trouble to the user. The Steps S46–S49 are similar to Steps S26–S29 in FIG. 14.

Further, in the above described case, if the user actually uses a simplex mode, the controller sends data indicative of such trouble to the data communication apparatus 200 and controls the image forming apparatus to continuously executes the image forming process in the simplex mode and controls the display 142 not to display the above-described messages, since such messages are not urgently required by the user who uses the simplex mode without any trouble therein. Thus, the display 142 continues to display the messages used for the image forming process (Step S45).

Further, even if the image forming apparatus is not used, each of the above described causes of trouble is transmitted either to the data communications apparatus 200 or the central control apparatus 400 via the data communications apparatus 200. The controller recognizes the above-described modes by checking a status of an operational key disposed on the display 142 for setting the modes.

Figure 17:
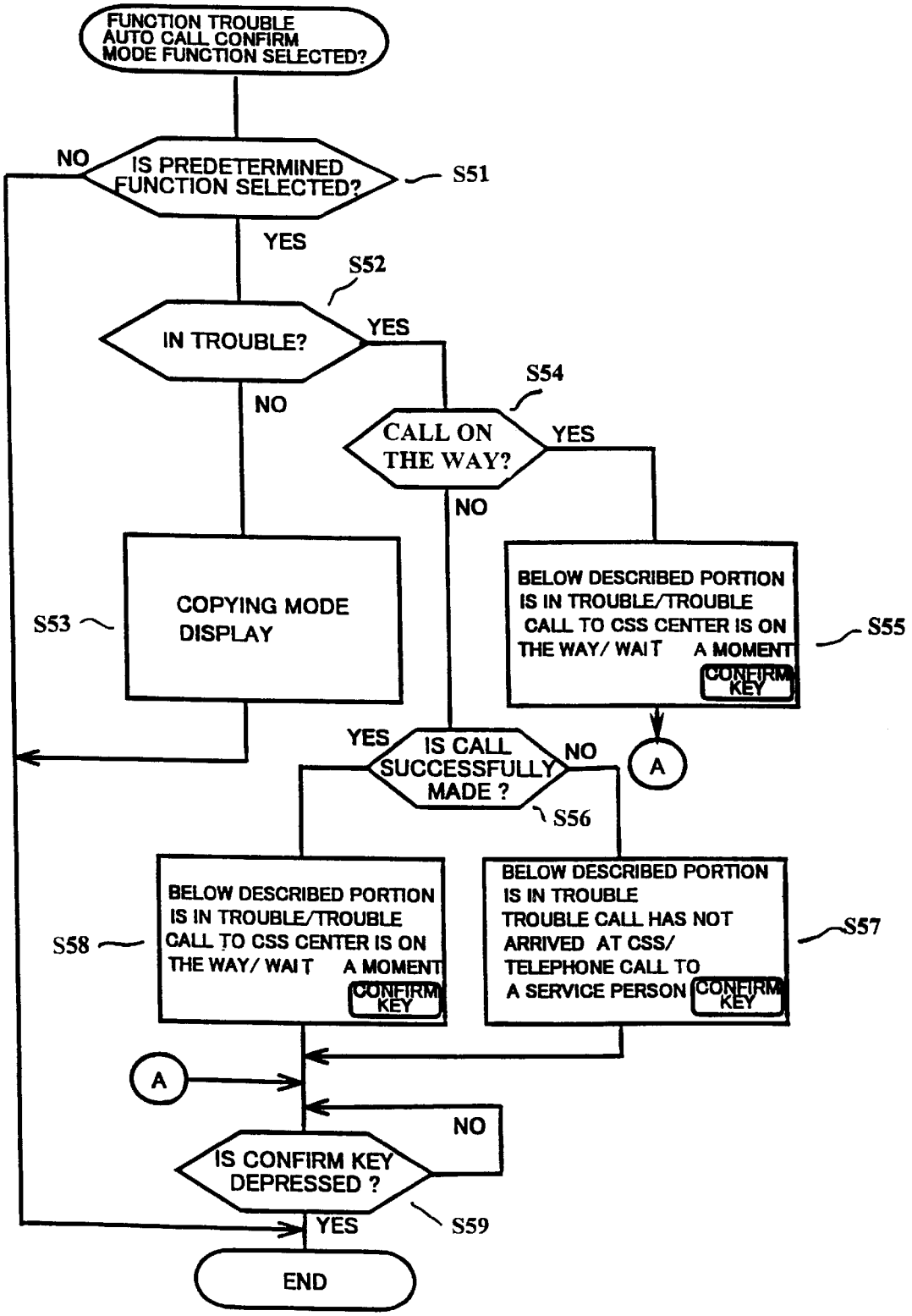
FIG. 17 is a flow chart illustrating control of a display when a user depresses a mode clear key after data communications between the central control apparatus and one of the image forming apparatus of the present invention.

According to the fourth embodiment of the present invention, as shown in FIG. 17, if some trouble occurs in the duplex mode, for example, and the user is using the simplex mode, or the image forming apparatus is not actually set in a simplex mode is set, the trouble is urgently transmitted to the central control apparatus 400 and messages to be used for the image forming process are still displayed on the display 142 (Steps S51–S53).

However, the trouble is transmitted to the user by displaying trouble related messages, if the above-described simplex mode is completed, or a duplex mode is newly set after absence of use of the image forming apparatus. A plurality of message types each for indicating results of data communications from the image forming apparatus to the central control apparatus 400 is in trouble can be selectively displayed on the display 142 as described below. A type of message may indicate that the trouble is on the way of being transmitted to the central control apparatus 400 (Steps S54 and S55). Such messages are only displayed on the display 142, if the user selects the duplex mode shortly after the trouble occurred in the duplex related devices.

A second type of message may indicate that the trouble has been transmitted to the central control apparatus 400. Such messages are displayed on the display 142, if the duplex mode is selected by the user after the trouble occurred in the duplex related device is transmitted to the central control apparatus 400 and the image forming apparatus receives a response from the central control apparatus 400 indicating that data communication of the trouble is successful (Steps S54, S56 and S58).

A third type of messages may indicate that the trouble has not been successfully transmitted to the central control apparatus 400. Such messages are displayed on the display 142, if the duplex mode is selected and a predetermined period of time has elapsed after the trouble is started to be transmitted to the central control apparatus 400, or a response indicating failure of data communication to the central control apparatus 400 is received from the data communication apparatus 200 (Steps S54, S56 and S57). After the trouble is cleared by repairing the duplex related devices, for example, messages for the image forming process are displayed again.

A mode clear key, not shown, may be employed and is used to clear the duplex mode after the trouble occurs in the duplex related devices. Thus, if the trouble occurs in the duplex mode, the mode can then be changed to the simplex mode to enable a simplex copy function and the message presently indicating the trouble is accordingly changed to the messages for the image forming process, when the mode clear key is depressed.

Numerous additional modifications and variations of the present invention are possible in light of the above teachings. It is therefore to be understood that within the scope of the appended claims, the present invention may be practiced otherwise than as specifically described herein.

What is claimed as new and desired to be secured by Lettes Patent of the United States is:

1. A remote diagnosis system, comprising:

a plurality of image forming apparatuses each having a respective trouble informing device which provides data including a trouble indicator indicative of a problem with a respective image forming apparatus of said plurality of image forming apparatuses;

a data communication apparatus, connected to each of said plurality of image forming apparatus, which receives said data from said respective image forming apparatus; and a central controller, connected to the data communication apparatus, which receives said data from said data communication apparatus, wherein each of said respective trouble informing device includes a trouble classifying device which classifies a cause of said trouble indicator which has occurred in said respective image forming apparatus, and wherein said data communication apparatus collects data classified by said trouble classifying device, wherein said trouble classifying device classifies troubles which cause said respective image forming apparatus to be inoperative as urgent information data, when said trouble occurs, wherein said trouble classifying device classifies causes of troubles which do not cause said respective image forming apparatus to be inoperative as non-urgent information data, when said trouble occurs, and wherein said trouble informing device transmits said urgent information to said central controller prior to said non-urgent information.

2. A remote diagnosis system as claimed in claim 1, wherein said respective image forming apparatus includes an image forming controller which stops an image forming process of said respective image forming apparatus corresponding to said cause of trouble classified by said trouble classifying device.

3. A remote diagnosis system as claimed in claim 1, further comprising:

a plurality of displays respectively disposed in each of said image forming apparatus and which displays predetermined messages thereon.

4. A remote diagnosis system as claimed in claim 1, wherein:

said trouble classifying device classifies causes of troubles which have occurred in an operation mode of said respective image forming apparatus as non-urgent information data, when another operation mode different from said operation mode is being used.

5. A remote diagnosis system as claimed in claim 1, further comprising:

a plurality of display controllers respectively disposed in each of said image forming apparatus and which controls said display corresponding to said trouble classified by said trouble classifying device.

6. A remote diagnosis system as claimed in claim 5, wherein:

one of said plurality of display controllers controls said display to display predetermined messages when said trouble is regarded as urgent.

7. A remote diagnosis system as claimed in claim 6, wherein:

said messages indicate that said data including said trouble indicator is being transmitted to said central controller.

8. A remote diagnosis system as claimed in claim 1, wherein said trouble informing device informs said trouble to a remote terminal in a predetermined priority.

9. A remote diagnosis system as claimed in claim 8, wherein said data communication apparatus temporarily stores said non-urgent information before transmitting said non-urgent data to said central controller.

10. An image forming apparatus, comprising:

trouble which senses a trouble which may occur during an operation thereof;

a trouble classifying device which classifies causes of said trouble which may occur in said image forming apparatus, wherein a plurality of causes of trouble classified by said trouble classifying device are automatically transmitted to a data communication apparatus; and a trouble informing device which provides data including a trouble indicator indicative of a problem with the image forming apparatus, wherein said trouble classifying device classifies troubles which cause said image forming apparatus to be inoperative as urgent information data, when said trouble occurs.

wherein said trouble classifying device classifies causes of troubles which do not cause said image forming apparatus to be inoperative as non-urgent information data, when said trouble occurs, and wherein said trouble informing device transmits said urgent information to a central controller prior to said non-urgent information.

11. An image forming apparatus as claimed in claim 10, further comprising:

a display which displays messages indicating that information corresponding to said trouble is being transmitted to a central control apparatus.

12. A method for sending a request from a plurality of image forming apparatuses to a central control apparatus, comprising the steps of:

sensing one or more causes of trouble which may occur in a respective image forming apparatus of said plurality of image forming apparatuses;

classifying said one or more causes of troubles into urgent information if the one or more causes of trouble causes said respective image forming apparatus to be inoperative;

classifying said one or more causes of troubles into non-urgent information if the one or more causes of trouble causes said respective image forming apparatus to not be inoperative;

storing said one or more causes of trouble in a memory of said respective image forming apparatus;

polling said plurality of image forming apparatuses for collecting data indicative of said one or more causes of trouble; and transmitting said urgent information to a central controller prior to said non-urgent information.

13. A method as claimed in claim 12, further comprising the step of:

controlling each of said plurality of image forming apparatuses corresponding to said classified causes of trouble.

14. A method as claimed in claim 12, further comprising the step of:

controlling a display to indicate messages corresponding to said sensed causes of trouble.

* * * * *